US006592059B2

(12) United States Patent
Ito et al.

(10) Patent No.: US 6,592,059 B2
(45) Date of Patent: Jul. 15, 2003

(54) FOREIGN MATTER ENTANGLEMENT-PREVENTING DEVICE IN WORKING ENGINE

(75) Inventors: Keita Ito, Wako (JP); Takao Nishida, Wako (JP); Takeshi Maeda, Wako (JP); Kenji Higashi, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/949,835

(22) Filed: Sep. 12, 2001

(65) Prior Publication Data

US 2002/0033148 A1 Mar. 21, 2002

(30) Foreign Application Priority Data

Sep. 13, 2000 (JP) ..... 2000-278544

(51) Int. Cl.[7] ..... B02C 19/00
(52) U.S. Cl. ..... 241/55; 241/101.78
(58) Field of Search ..... 30/276, 347; 56/12.7; 123/41.65; 241/101.78, 101.2, 185.6, 55

(56) References Cited

U.S. PATENT DOCUMENTS 2,340,457 A * 2/1944 Dion ..... 241/55
4,827,702 A * 5/1989 Cerreta ..... 56/12.7
5,511,281 A * 4/1996 Webster ..... 15/330
5,692,262 A * 12/1997 Haupt et al. ..... 15/339

FOREIGN PATENT DOCUMENTS

JP 61-25529 2/1986

* cited by examiner

*Primary Examiner*—Mark Rosenbaum
(74) *Attorney, Agent, or Firm*—Armstrong, Westerman & Hattori, LLP

(57) ABSTRACT

In a working engine including a bearing mounted on an outer wall of a crankcase for carrying a crankshaft, an oil seal mounted on the outer wall of a crankcase and disposed outside and adjacent the bearing, and a cooling fan which is attached to an outer end of the crankshaft adjacent the oil seal with its blades turned toward the crankcase and which has blades protruding toward the crankcase, a cylindrical protective tube is formed on an outer sidewall of the crankcase to cover ends of bosses of the cooling fan, and a foreign matter-beating piece is formed on the cooling fan 16 in proximity to an outer peripheral surface of the protective tube. Thus, even if a long foreign matter drawn in by the cooling fan such as a weed and the like has been entangled around the crankshaft, it can be beaten and loosened, or cut by the foreign matter-beating piece rotated along with the cooling fan. Therefore, it is possible to prevent the entanglement around the foreign matter around the crankshaft, thereby avoiding damage to the oil seal as a result of the entanglement.

3 Claims, 3 Drawing Sheets

FOREIGN MATTER ENTANGLEMENT-PREVENTING DEVICE IN WORKING ENGINE

BACKGROUND OF THE INVENTION

1. Field of the Invention

The present invention relates to a working engine serving as a power source mainly for a trimmer or another portable working machine, and more particularly, to a foreign matter entanglement-preventing device, which is mounted in a working engine including a bearing mounted on an outer wall of a crankcase for carrying a crankshaft, an oil seal mounted on the outer wall of a crankcase and disposed outside and adjacent the bearing to come into close contact with an outer peripheral surface of the crankshaft, and a cooling fan attached to an outer end of the crankshaft adjacent the oil seal with its blades turned toward the crankcase, and which is adapted to prevent foreign matter such as weeds and the like from being drawn in by the cooling fan and being entangled around the crankshaft, thereby avoiding damage to the oil seal as a result of the entangled foreign matter.

2. Description of the Related Art

Such a foreign matter entanglement-preventing device in a working engine is already known, for example, as disclosed in Japanese Patent Application Laid-open No.61-25529.

In the foreign matter entanglement-preventing device disclosed in the above Japanese Patent Application Laid-open No.61-25529, a cylindrical protective tube is formed on an outer sidewall of a crankcase to surround ends of bosses of a cooling fan, while covering a crankshaft, so that the entering of foreign matter toward the crankshaft is prevented by the bosses and the protective tube. In the above structure, however, when the foreign matter has been once entangled around an outer periphery of the cylindrical protective tube, the foreign matter may be accumulated and ultimately enters into a gap between the protective tube and the bosses of the cooling fan, resulting in the occurrence of the entanglement of the foreign matter around the crankshaft.

SUMMARY OF THE INVENTION

Accordingly, it is an object of the present invention to provide a foreign matter entanglement-preventing device in a working engine, which has a simple structure and is capable of reliably preventing the entanglement of a foreign matter around a crankshaft.

To achieve the above object, according to the present invention, there is provided a foreign matter entanglement-preventing device in a working engine which includes a bearing mounted on an outer wall of a crankcase for carrying a crankshaft, an oil seal also mounted on the outer wall of the crankcase and disposed outside and adjacent the bearing to come into close contact with an outer peripheral surface of the crankshaft, and a cooling fan attached to an outer end of the crankshaft adjacent the oil seal with its blades turned toward the crankcase. The foreign matter entanglement-preventing device includes a cylindrical protective tube formed on an outer sidewall of the crankcase to cover ends of bosses of the cooling fan, while covering the crankshaft, and a foreign matter-beating piece formed on the cooling fan in proximity to an outer peripheral surface of the protective tube.

With such features, if a long piece of foreign matter such as a weed and the like, is entangled and accumulated around an outer periphery of the protective tube, the foreign matter-beating pieces rotated along with the cooling fan beat and loosen, or cut and drop the foreign matter. In this manner, the entering of the foreign matter into the protective tube can be inhibited. Therefore, it is possible to prevent the foreign matter from being entangled around the crankshaft within the protective tube, thereby avoiding damage to the oil seal as a result of the entanglement.

Moreover, the protective tube and the foreign matter-beating pieces integrally formed respectively on the crankcase and the cooling fan do not increase the number of parts of the engine and hence, the foreign matter entanglement-preventing device can be provided in a simple structure and at a low cost.

The above and other objects, features and advantages of the present invention will become apparent from the following description of the preferred embodiment taken in conjunction with the accompanying drawings.

DESCRIPTION OF THE PREFERRED EMBODIMENT

The present invention will now be described by way of a preferred embodiment with reference to the accompanying drawings.

Figure 1:
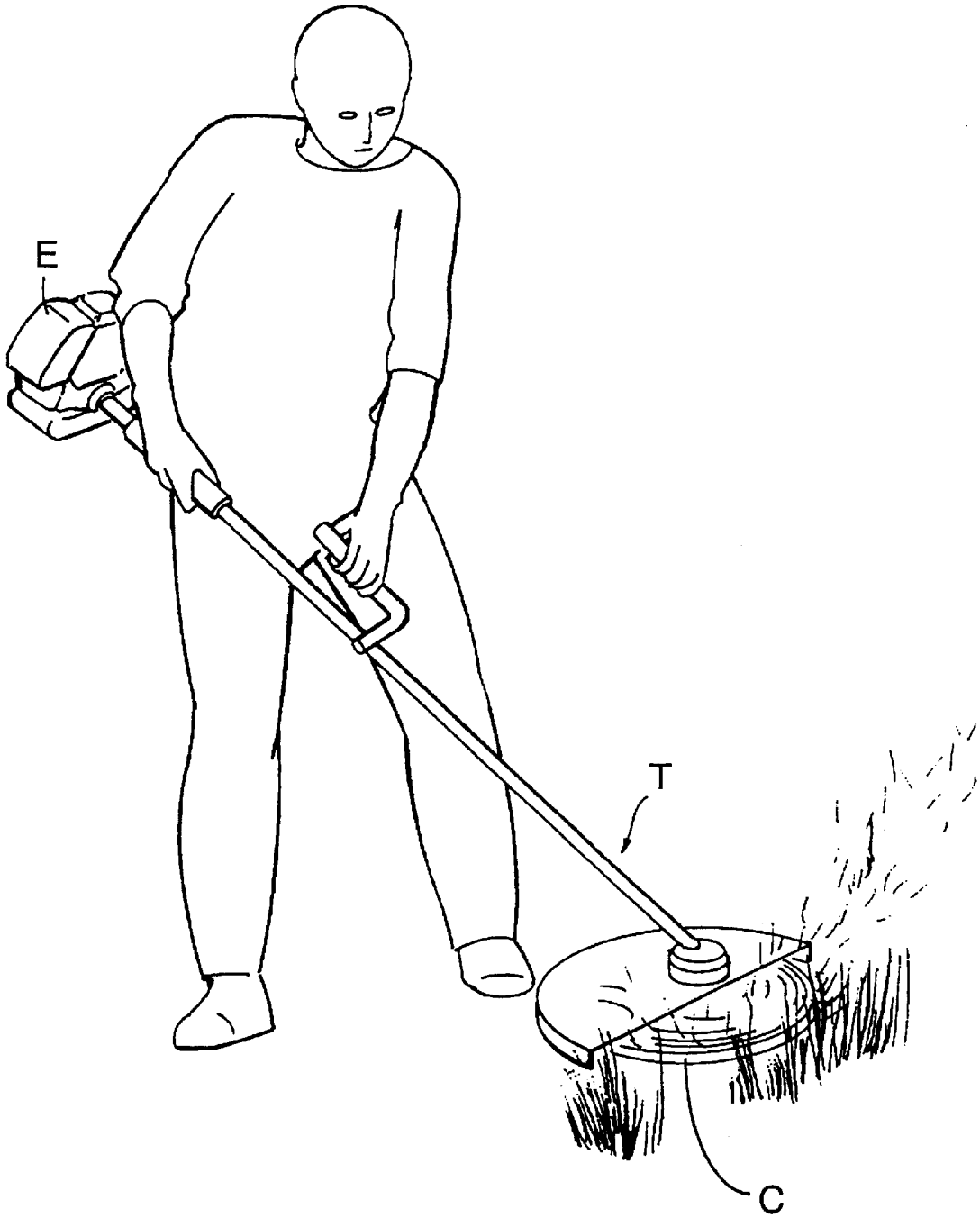
FIG. 1 is a perspective view showing one example of use of a working engine according to the present invention.

As shown in FIG. 1, a working engine E is attached as a power source, for example, to the power trimmer T. The power trimmer T cuts away weeds or the like by a cutter C rotated at a high speed by the engine E.

Figure 2:
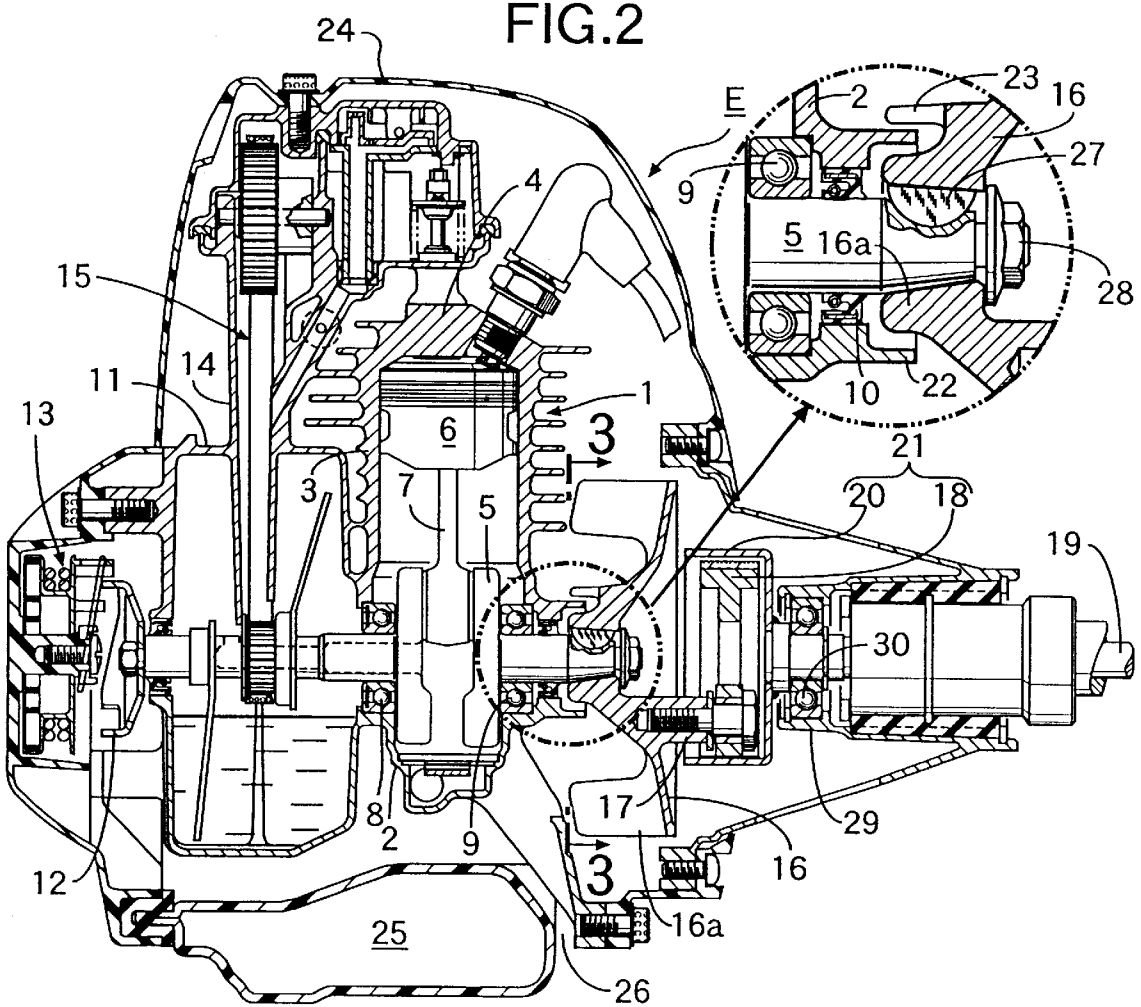
FIG. 2 is a vertical sectional view of the engine.

Referring to FIG. 2, the engine E is formed into a 4-cycle type and includes an engine body 1 comprising a crankcase 2, a cylinder block and a cylinder head 4. An oil tank 11 is integrally connected to one sidewall of the crankcase 2.

A crankshaft 5 accommodated in the crankcase 2 is connected through a connecting rod 7 to a piston 6 capable of being lifted and lowered within a cylinder bore in the cylinder block 3. The crankshaft 5 is carried on laterally opposite sidewalls of the crankcase 2 with ball bearings 8 and 9 interposed therebetween. The left ball bearing 8 as viewed in FIG. 2 has a seal, and an oil seal 10 is disposed outside and adjacent the right ball bearing 9 and mounted to the right sidewall of the crankcase 2 to come into close contact with an outer periphery of the crankshaft 5.

The crankshaft 5 extends through the oil tank 11, so that its left end protrudes on an outer side of the oil tank 11, and a recoil starter 13 is mounted to an outer sidewall of the oil tank 11 and is capable of being brought into engagement with a driven member 12 secured to the left end of the crankshaft 5.

A tubular belt guide 14 is integrally formed on a ceiling wall of the oil tank 11 to extend vertically through the ceiling wall. A timing transmitting device 15 of a valve-operating mechanism for opening and closing intake and exhaust valves mounted in the cylinder head 4 are accommodated in the tubular belt guide 14, so that the timing transmitting device 15 is lubricated by oil stored in the oil tank 11.

Bosses 16*a* of a cooling fan 16 also serving as a flywheel are fitted over an end of the crankshaft 5 adjacent the oil seal through a key 27 and secured to such end by a nut 28. A plurality of mounting bosses 17 (one of which is shown in FIG. 2) are formed on an outer side of the cooling fan 16, and a centrifugal shoe 18 is swingably supported on the mounting bosses 17. The centrifugal shoe 18 constitutes a centrifugal clutch 21 (a power take-off means) together with a clutch drum 20 secured to a drive shaft 19 for the cutter C. When the rotational speed of the crankshaft 5 exceeds a predetermined value, the centrifugal shoe 18 is brought into pressure contact with an inner peripheral wall of the clutch drum 20 by its own centrifugal force to transmit a torque output from the crankshaft 5 to the drive shaft 19.

The cooling fan 16 has a diameter larger than that of the centrifugal clutch 21, and includes blades 16*b* disposed in annular arrangement to protrude from a side of an outer periphery thereof toward the crankcase 2. The bosses 16*a* of the cooling fan 16 protrude near the oil seal 10, and a cylindrical protective tube 22 is integrally formed on the outer side of the crankcase 2 in close proximity to the outer peripheral surfaces of the bosses 16*a* to surround the bosses 16*a*. A portion of the crankshaft 5 protruding from the oil seal 10 is covered with the protective tube 22.

Figure 3:
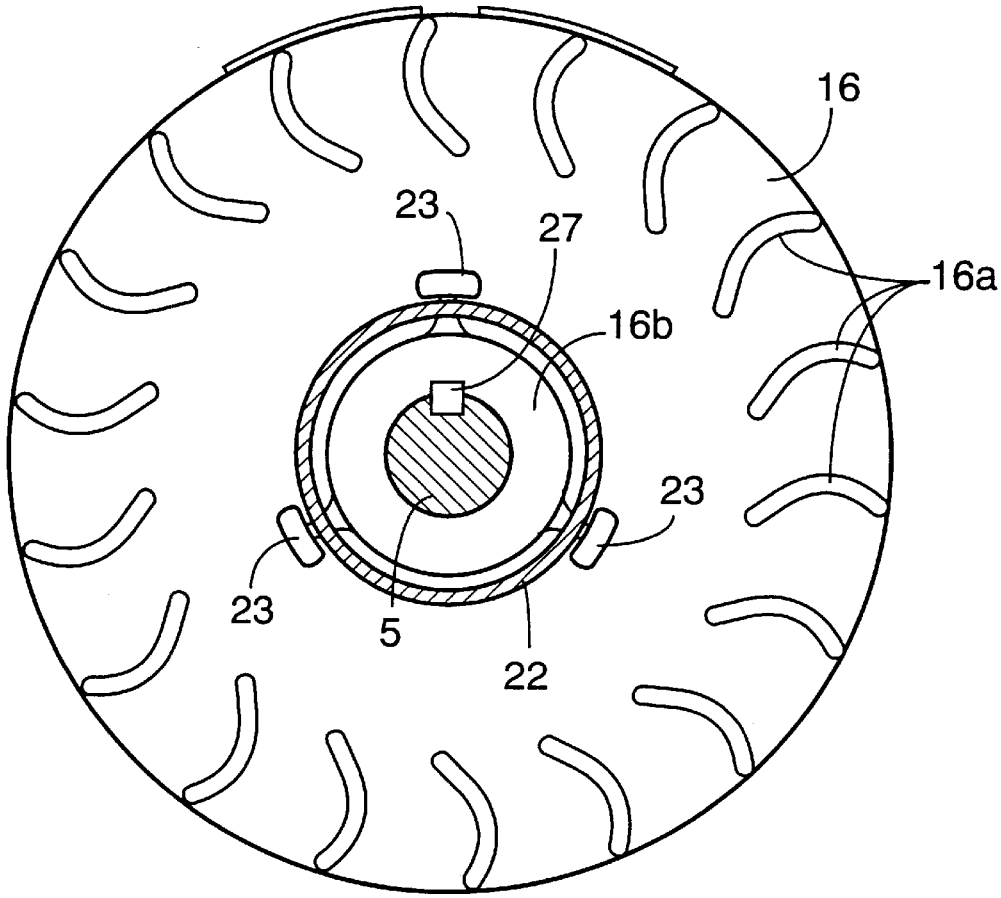
FIG. 3 is a view taken along a line 3—3 in FIG. 2 (a front view of a cooling fan).

Several (three in the illustrated embodiment) foreign matter-beating pieces 23 are integrally formed on the cooling fan 16 at circumferentially equal distances to protrude near an outer peripheral surface of a tip end of the protective tube 22, as shown in FIGS. 2 and 3.

Referring again to FIG. 2, an engine cover 24 is attached to the engine body 1 to cover the engine body 1, and a fuel tank 25 is disposed below the crankcase 2 and supported on the engine cover 24. A cooling-air introduction opening 26 is provided between the fuel tank 25 and the engine cover 24, so that the outside air, i.e., cooling air introduced through the cooling-air introduction opening 26 is supplied to various portions of the engine by rotation of the cooling fan 16.

A truncated conical bearing holder 29 is arranged coaxially with the crankshaft 5 and secured to the engine cover 24. The bearing holder 29 supports the drive shaft 19 for the cutter C with a bearing 30 interposed therebetween.

The operation of this embodiment will be described below.

When weeds or the like are being cut away by operating the engine E to rotate the cutter C at a high speed by an output from the crankshaft 5, if there is foreign matter such as the cut weeds incorporated in the cooling air drawn through the cooling-air introduction opening 26 by the rotation of the cooling fan 16, such foreign matter, if it is relatively long, is entangled around the periphery of the protective tube 22 and accummulates thereon. When the amount of weeds accumulated is increased, the foreign matter is moved toward the tip end of the protective tube 22. Then, the foreign matter is beaten and loosened, or cut and dropped, by the foreign matter-beating pieces 23 which are on standby around the outer periphery of the tip end of the protective tube 22 and which are being rotated along with the cooling fan 16. In this case, the arrangement of the foreign matter-beating pieces 23 at equal distances in the circumferential direction of the cooling fan 16 is effective for effectively conducting the foreign matter beating or cutting operation.

In this manner, the foreign matter is inhibited from entering into the protective tube 22 through a gap between the protective tube 22 and the bosses 16*a* of the cooling fan 16. Therefore, the foreign matter cannot be entangled around the crankshaft 5 within the protective tube 22 and thus, it is possible to previously avoid the damaging of the oil seal 10 due to the entangling of the foreign matter.

Moreover, the protective tube 22 and the foreign matter-beating pieces 23 are integrally formed on the crankcase 2 and the cooling fan 16, respectively and hence, the foreign matter entanglement-preventing device can be provided in a simple structure and at a low cost without bringing about an increase in number of part of the engine.

Although the embodiments of the present invention have been described in detail, it will be understood that the present invention is not limited to the above-described embodiments, and various modifications in design may be made without departing from the spirit and scope of the invention defined in claims. For example, the number of the foreign matter-beating pieces 23 may be one or plurality. When a plurality of foreign matter-beating pieces 23 are provided, it is desired that they are arranged at sufficient distances in order to increase the shock applied to the foreign matter to the utmost.

What is claimed is:

1. A foreign matter entanglement-preventing device in a working engine, said engine including a bearing mounted on an outer wall of a crankcase for carrying a crankshaft, an oil seal also mounted on the outer wall of the crankcase and disposed outside and adjacent said bearing to come into close contact with an outer peripheral surface of the crankshaft, and a cooling fan attached to an outer end of the crankshaft adjacent said oil seal with its blades turned toward the crankcase, said foreign matter entanglement-preventing device comprising:

a cylindrical protective tube formed on an outer sidewall of the crankcase to cover ends of bosses of the cooling fan, while covering the crankshaft; and a foreign matter-beating piece formed on the cooling fan in close proximity to an outer peripheral surface of said protective tube.

2. A foreign matter entanglement-preventing device in a working engine according to claim 1, wherein a plurality of said foreign matter-beating pieces are disposed at distances in a circumferential direction of the cooling fan.

3. A foreign matter entanglement-preventing device in a working engine according to claim 1 or 2, further including a power take-off means for driving a working machine is mounted on the side of said cooling fan opposite from said crankcase.

* * * * *